US005595288A

United States Patent [19]

Matsui et al.

[11] Patent Number: 5,595,288

[45] Date of Patent: Jan. 21, 1997

[54] THIN SWITCH INCLUDING DOMED CONTACT

[75] Inventors: Hiroshi Matsui, Hirakata; Tamotsu Yamamoto, Ashiya; Yukihiro Ishihara, Kaizuka, all of Japan

[73] Assignee: Matsushita Electric Industrial Co., Ltd., Osaka, Japan

[21] Appl. No.: 444,152

[22] Filed: May 18, 1995

[30] Foreign Application Priority Data

Jul. 14, 1994 [JP] Japan ..... 6-162010

[51] Int. Cl.[6] ..... H01H 1/10

[52] U.S. Cl. ..... 200/513; 200/275; 200/239; 200/284; 200/512; 29/622

[58] Field of Search ..... 200/521, 512, 200/513, 514, 515, 516, 517, 239, 275, 284; 29/622

[56] References Cited

U.S. PATENT DOCUMENTS

| | | | |
|---|---|---|---|
| 3,590,331 | 6/1971 | Kirsch . | |
| 3,995,128 | 11/1976 | Hawkins | 200/517 |
| 4,438,304 | 3/1984 | Kennedy . | |
| 4,800,245 | 1/1989 | Murmann et al. | 200/517 |
| 4,803,321 | 2/1989 | Lefebvre | 200/517 |
| 5,224,591 | 7/1993 | Santo et al. | 200/512 |
| 5,512,721 | 4/1996 | Young et al. | 200/512 |

FOREIGN PATENT DOCUMENTS

| | | |
|---|---|---|
| 2705756 | 8/1978 | Germany . |
| 60-236420 | 11/1985 | Japan . |
| 63-66809 | 3/1988 | Japan . |
| 2-195615 | 8/1990 | Japan . |
| 4315717 | 11/1992 | Japan . |
| 6168641 | 6/1994 | Japan . |
| 6203698 | 7/1994 | Japan . |
| 2004126 | 3/1979 | United Kingdom . |

*Primary Examiner*—David J. Walczak
*Attorney, Agent, or Firm*—Ratner & Prestia

[57] ABSTRACT

A thin switch includes, (a) a rectangular insulating substrate, (b) a unitary fixed contact member comprising a T-shaped conductive thin-metal including a fixed contact, a first terminal, and a first conductive part therebetween, and (c) a movable contact member including a unitary elastic and T-shaped conductive thin-metal including a domed contact, a second terminal, and a second conductive part therebetween. The fixed contact member is placed so that the fixed contact is located roughly at the center of a surface of the insulating substrate and the first terminal is located at one edge of the insulating substrate. The first terminal is attached to the insulating substrate. The movable contact member is placed so that the domed contact is located over the fixed contact and the second terminal is located at the opposite edge of the insulating substrate. The second terminal is attached to the insulating substrate.

12 Claims, 4 Drawing Sheets

THIN SWITCH INCLUDING DOMED CONTACT

BACKGROUND OF THE INVENTION

The present invention relates to a thin switch including a domed contact, which is used as a signal switch in portable electronic devices such as a movable telephone.

The signal switch mounted on a surface of a portable electronic device primarily requires thinness. FIG. 12(A) and FIG. 12(B) illustrate a thin switch having a domed contact, which is typically used on a surface of a portable electronic device.

This thin switch comprises, housing 1 made from a resin, coupling terminals 2 and 3 mounted to the housing for coupling the thin switch to an outer circuit, outer fixed ring-shape contact 4 mounted on the bottom of the housing, center fixed disc-shape contact 5 mounted at the center of the outer fixed ring-shape contact 4, domed movable contact 6 made of an elastic thin-metal-plate, which is mounted so that the circumference always contacts the outer fixed contact 4, and insulating film 7 covering an open surface of housing 1. Terminal 2 and outer fixed contact 4 are a unitary structure made from a metal sheet. Terminal 3 and center fixed contact 5 are also a unitary structure made from a metal sheet. These unitary forms are fixed to housing 1 through an insertion molding process.

When the center part of insulation film 7 is pressed, a tip of movable contact 6 is lowered to touch center fixed contact 5, which makes fixed contact 4 and center fixed contact 5 electrically conductive, in other words, terminal 2 and terminal 3 become conductive. When the pressing force is removed, movable contact 6, because of its elastic properties restores itself to an initial dome form, which terminates the conduction between terminal 2 and terminal 3.

Recently, portable electronic devices require reduced size and cost, which places the same requirement on the thin switch mounted on the surface of the portable electronic device, namely the thin switch must be thinner and be available at a lower cost. However, since a conventional thin switch is made by an insert-molding method, it is difficult to meet this requirement. A certain thickness is necessary for filling up a mold with sufficient resin, which prevents the thin switch from becoming thinner than a certain limit. For instance, a square switch of 5 mm side length cannot be thinner than 0.8 mm in thickness.

Furthermore, a mold used in the insert-molding method has a complicated structure and is expensive. Molding equipment is also expensive. Accordingly, it is difficult for the thin switch producer to lower the manufacturing cost.

The present invention provides a thin switch which overcomes these problems.

SUMMARY OF THE INVENTION

A thin switch according to the present invention comprises, (a) an insulating substrate, (b) a fixed contact member comprising a unitary conductive thin plate containing a fixed contact and a first terminal, and (c) a movable contact member comprising unitary elastic conductive thin plate containing a domed conduct and a second terminal.

In this structure, the fixed contact member is placed so that the fixed contact is located approximately at a center of the insulating substrate surface, and the fixed contact member is fixed thereto. The movable contact member is placed over the fixed contact so that the domed contact covers the fixed contact, and the movable contact member is also fixed to the insulating substrate.

The thin switch having the above structure has the following advantages when compared with a conventional thin switch:

1. Since the insulating substrate is used instead of the resin-made housing manufactured by the insert-molding method, the thickness of the switch can be thinner.
2. Since the fixed contact and first terminal are unitized and the domed contact and second terminal are unitized, the number of components is reduced, which makes assembly easier.
3. The insulating substrate, fixed contact member and movable contact member do not require expensive manufacturing equipment, such as a press-process, but only need simple manufacturing methods, which enables these parts to be manufactured continuously which yields a large volume at one time. The manufacturing costs thus can be lowered.

DESCRIPTION OF THE PREFERRED EMBODIMENTS

A first exemplary embodiment of a thin switch according to the present invention is explained by referring to FIG. 1, FIG. 2, FIG. 3(A), FIG. 3(B), FIG. 4 and FIG. 5.

The thin switch comprises, (a) square insulating substrate 11 (side length=5 mm, thickness=0.2 mm) punched out of a thin board made of glass-epoxy-resin, (b) fixed contact member 12 punched out of an elastic conductive plate (thickness=0.05 mm) made of phosphor bronze into a T-shape, and (c) movable contact member 13 punched out of an elastic conductive plate into a T-shape.

Protrusion 12G is formed on fixed contact member 12, at the tip of T-shape conductive part 12C, and this tip is fixed contact 12A. The other two bent tips are terminals 12B to be soldered to a wired board of an electric device. Concave part 12D is formed on conductive part 12C near fixed contact 12A. Fixed contact member 12 is placed so that fixed contact 12A is set proximate to the center of insulating substrate 11 and also concave part 12D is engaged with slot 11A of insulating substrate 11. Insulating tape 14 has glue on both faces and includes slot 14A corresponding to concave part 12D. Insulating tape 14 attaches fixed contact member 12 to insulating substrate 11. The shape of slot 11A is not necessarily slot-shaped, but it may be D-shaped, or U-shaped.

Domed contact 13A is formed on movable contact member 13, at the side extending approximately from the center of conductive part 13C. Both bent ends of conductive part 13C serve as terminals 13B. Movable contact member 13 is placed on insulating substrate 11 so that the tip of domed contact 13A is set over protrusion 12G without domed contact 13A touching fixed contact member 12. Movable contact member 13 is glued to insulating substrate 11 with insulating tape 14. Concave part 12D not only engages itself with slot 11A, but also provides an insulating space between the circumference (periphery) of domed contact 13A and conductive part 12C of fixed contact member 12.

This thin switch has a thickness of 0.6 mm or less, which is substantially thinner than a conventional thin switch.

Operation of this thin switch is explained below.

As shown in FIG. 3 (B), when the center of domed contact 13A is pressed, the inner surface of the dome touches protrusion 12G of fixed contact 12A, thereby electrically connecting terminals 12B and 13B. When the pressing force is removed, domed contact 13A restores itself to an initial domed shape and electrical conduction between terminals 12B and 13B is disconnected.

Figure 1:
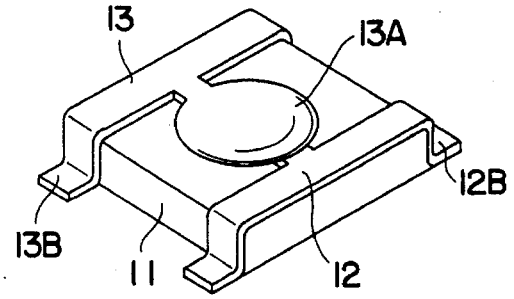
FIG. 1 is a perspective view of a first exemplary embodiment of a thin switch according to the present invention.
Figure 2:
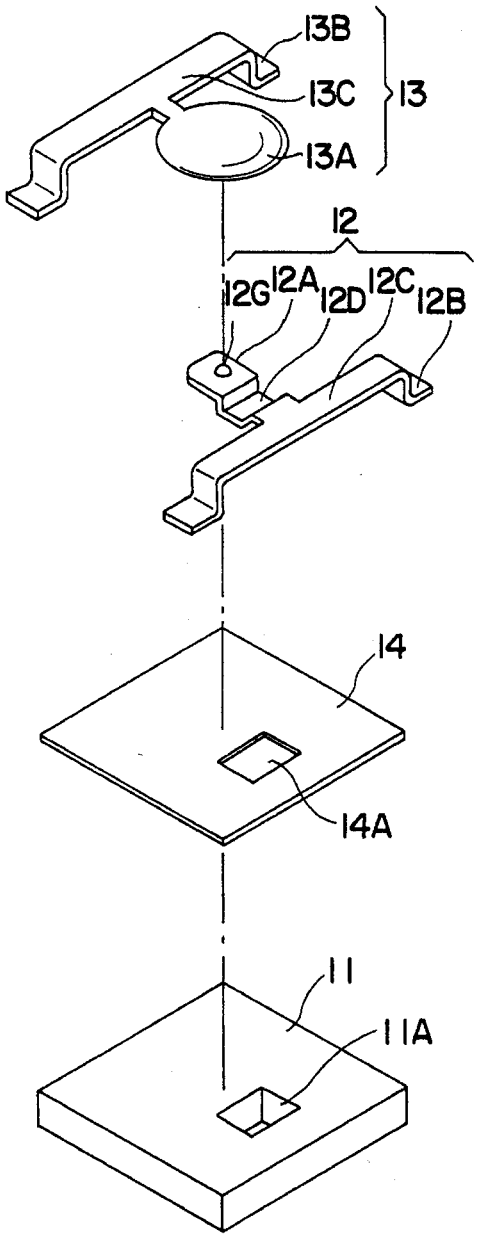
FIG. 2 is an exploded view of the thin switch shown in FIG. 1.
Figure 4:
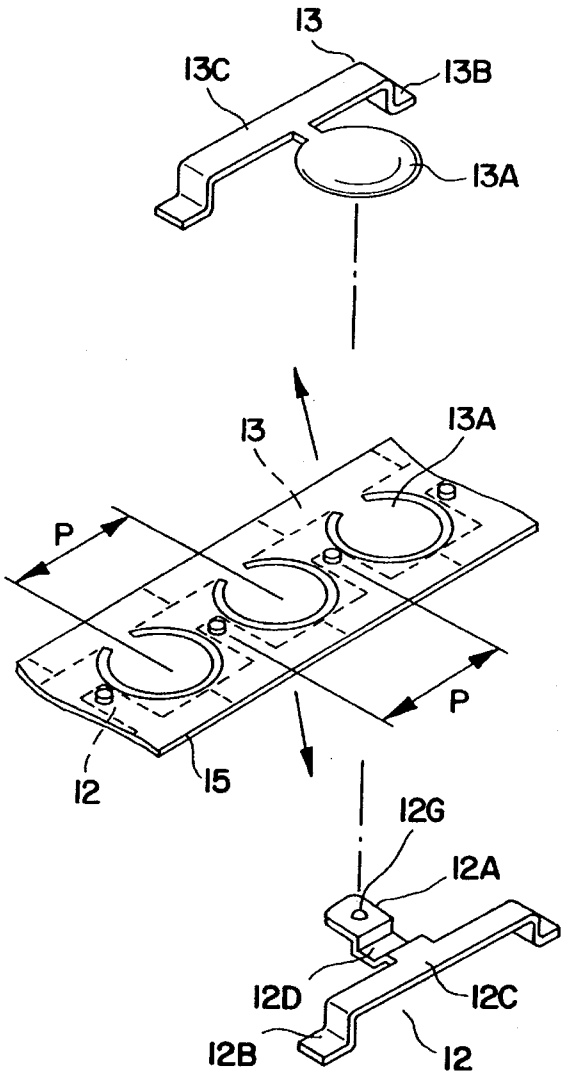
FIG. 4 illustrates a first method of making a fixed contact member and movable contact member out of a thin metal plate.

In manufacturing the thin switch of FIG. 1, as FIG. 4 shows, fixed contact member 12 and movable contact member 13 are simultaneously produced by punching and bending from a thin metal strip 15 which has pre-cuts thereon corresponding to the circles of domed contact 13A. Thin metal strip 15 is fed into a process machine with a constant interval P, allowing fixed contact member 12 and movable contact member 13 to be manufactured continuously.

FIG. 4 shows the method of manufacturing fixed contact member 12 and movable contact member 13 piece by piece on a continuous basis. However, when using a wider metal-thin-plate, multiple pieces can be manufactured with one shot.

Figure 5:
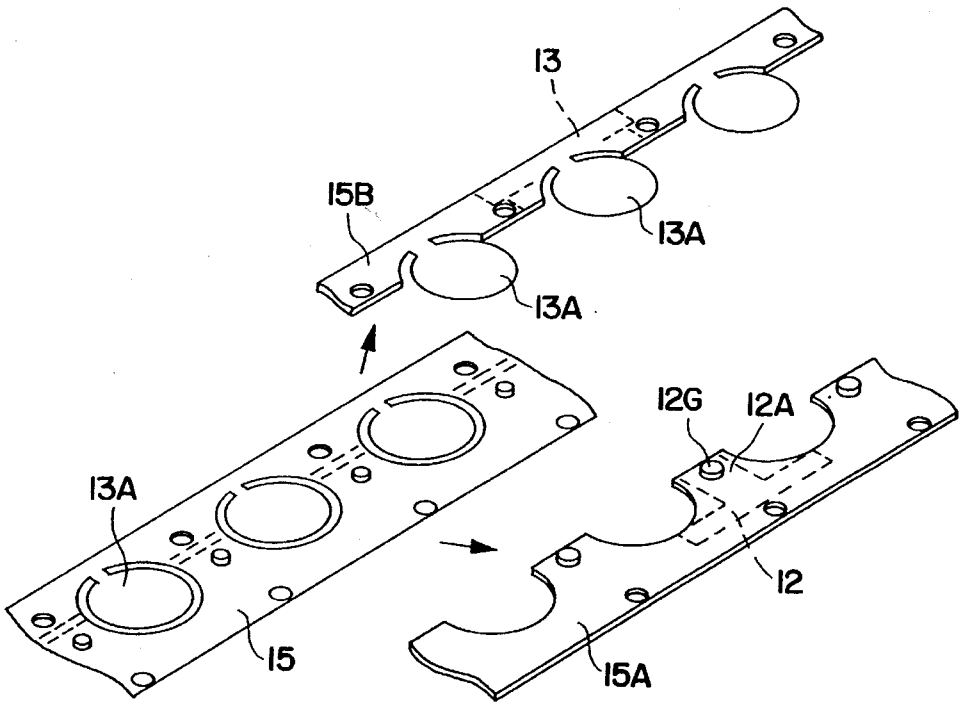
FIG. 5 illustrates a second method of making a fixed contact member and movable contact member out of the thin metal plate.

As shown in FIG. 5, additional pre-cuts of lines are provided on thin metal strip (plate) 15. The thin metal strip 15 is split into strip 15A for fixed contact member 12 and strip 15B for movable contact member 13. Then, through punching and bending, fixed contact member 12 and movable contact member 13 are independently manufactured on a continuous basis. When using automatic switch-manufacturing-equipment for continuous production, which combines manufacturing equipment of these members and assembly equipment of the thin switch, an advantage is revealed. The fixed contact member 12 and movable contact member 13 are fed into switch-assembly-equipment continuously, and thus continuous production quantities are achieved.

Figure 12A:
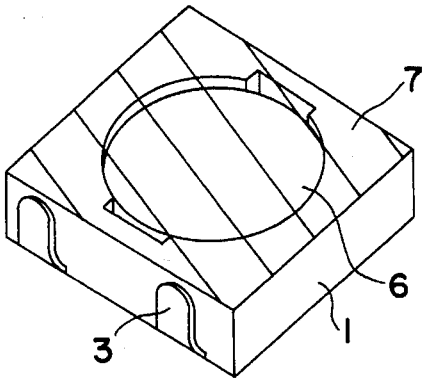
FIG. 12(A) PRIOR ART
FIG. 12(A) is a perspective view of a conventional thin switch.

In the above exemplary embodiment, since thin insulating substrate 11 is used instead of housing 1 (shown in FIG. 12A), the thin switch becomes substantially thinner than a conventional switch. Further, fixed-contact-member 12 which utilizes fixed contact 12A with terminal 12B, and movable-contact member 13 which unitizes movable contact 13A with terminal 13B are used to reduce the number of components and make assembly easier. In addition to these advantages, the members can be manufactured through simple methods such as a press process and do not require expensive equipment. They also allow use of an automatic continuous production system, which lowers manufacturing cost.

In this exemplary embodiment, insulating substrate 11 is made from a glass-epoxy-resin, however, epoxy-resin, phenol-resin, polymide-resin, other insulating resins and insulating ceramics may be used as materials for the substrate.

An elastic thin strip (plate) made of phosphor bronze is used for manufacturing fixed contact member 12 and movable contact member 13, however, stainless steel and other metals may be used.

Although the above exemplary embodiment shows that these two members are made from one thin metal strip fixed contact member 12 and movable contact member 13 can be made of different materials. In this case, a copper alloy or other conductive materials can be used for the fixed contact member 12.

Figure 6:
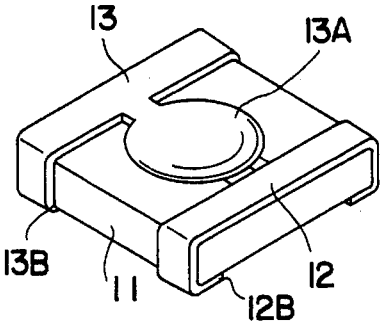
FIG. 6 is a perspective view of a second exemplary embodiment of the thin switch according to the present invention.

FIG. 6 shows a second exemplary embodiment, where fixed contact member 12 and movable contact member 13 are fixed to insulating substrate 11 by folding terminals 12B and 13B to hold insulating substrate 11. Accordingly, insulating tape 14 can be eliminated, and the number of components is thus reduced.

Figure 7A:
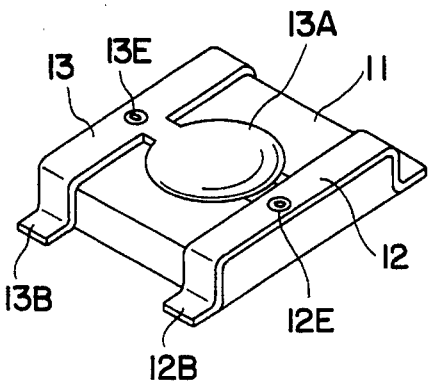
FIG. 7(A) is a perspective view of a third exemplary embodiment of the thin switch according to the present invention.
Figure 7B:
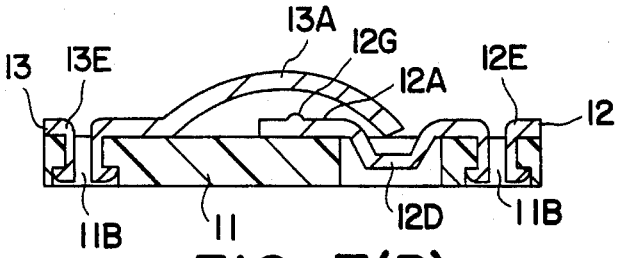
FIG. 7(B) is a cross sectional view of the thin switch shown in FIG. 7(A).

FIG. 7(A) and FIG. 7(B) show a third exemplary embodiment, where another fastening method is utilized. Protrusions 12E and 13E are formed on conductive parts 12C and 13C and inserted into slots lib punched on insulating substrate 11. The tips of inserted protrusions 12E and 13E are caulked to the rear side of insulating substrate 11 for securing fixed contact member 12 and movable contact member 13 to substrate 11.

Figure 3A:
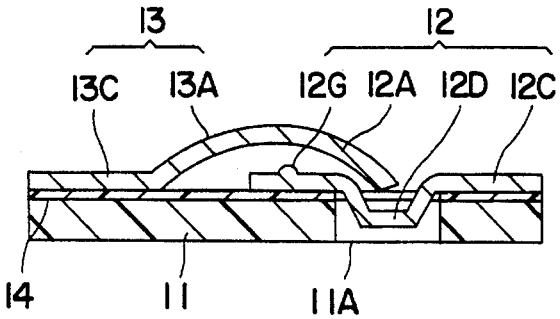
FIG. 3(A) is a cross sectional view of the thin switch shown in FIG. 1.
Figure 3B:
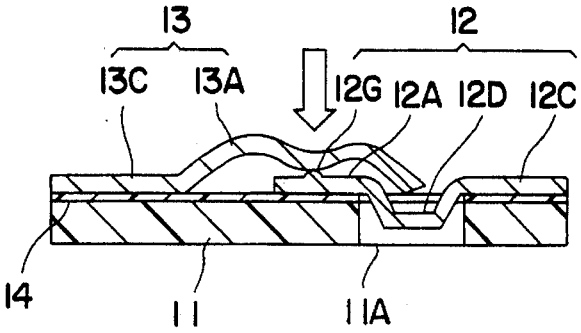
FIG. 3(B) is a cross sectional view of the thin switch of FIG. 1 illustrating the operation of the thin switch according to the present invention.
Figure 8B:
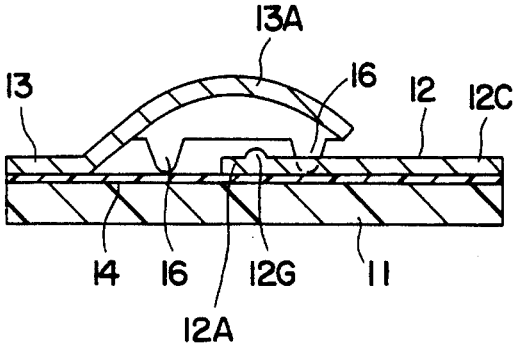
FIG. 8(B) is a cross sectional view of the thin switch shown in FIG. 8(A).
Figure 8A:
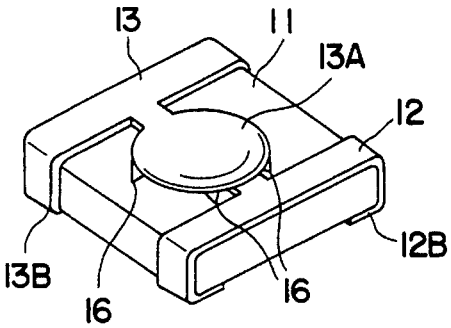
FIG. 8(A) is a perspective view of a fourth exemplary embodiment of the thin switch according to the present invention.

FIG. 8(A) and FIG. 8(B) show a fourth exemplary embodiment, where supporting protrusions 16 are provided on the under side of domed contact 13A near the circumference instead of providing concave part 12D and slot 11A as shown in FIG. 3(A). This provides an insulating space between conductive part 12C and domed contact 13A. Supporting protrusion 16 can be provided away from the circumference of domed contact 13A, provided that the supporting protrusion does not contact conductive part 12C.

Figure 9A:
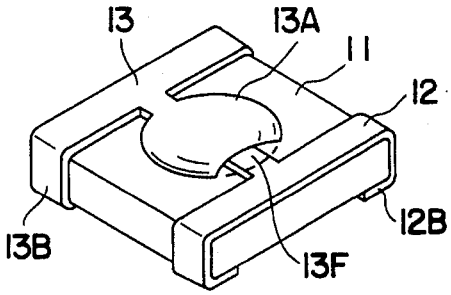
FIG. 9(A) is a perspective view of a fifth exemplary embodiment of the thin switch according to the present invention.
Figure 9B:
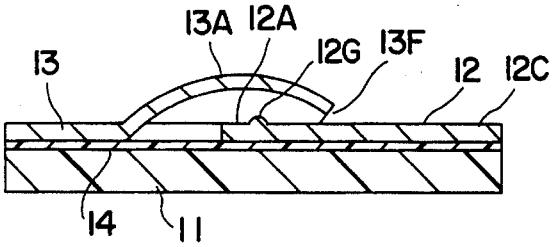
FIG. 9(B) is a cross sectional view of the thin switch is shown in FIG. 9(A).

FIG. 9(A) and FIG. 9(B) show a fifth exemplary embodiment, where another method of securing the insulating space is utilized. A particular circumference portion 13F which covers conductive part 12C is removed from domed contact 13A for securing the insulating space.

Figure 10A:
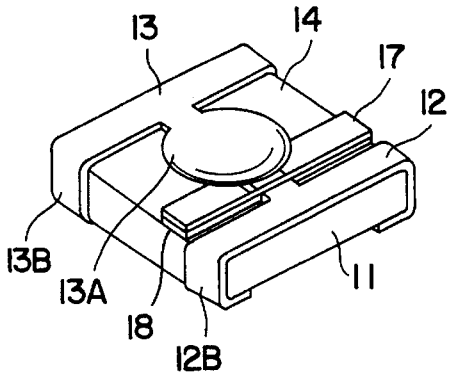
FIG. 10(A) is a perspective view of a sixth exemplary embodiment of the thin switch according to the present invention.
Figure 10B:
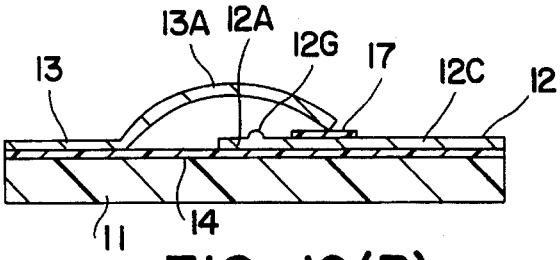
FIG. 10(B) is a cross sectional view of the thin switch shown in FIG. 10(A).

FIG. 10(A) and FIG. 10(B) show a sixth exemplary embodiment, where further another method of securing the insulating space is utilized. Insulating film 17 is inserted between the circumference of domed contact 13A and conductive part 12C, thereby providing an insulator. Insulating film 17 is glued to insulating substrate 11 with tape 18 having glue on both sides.

Figure 11B:
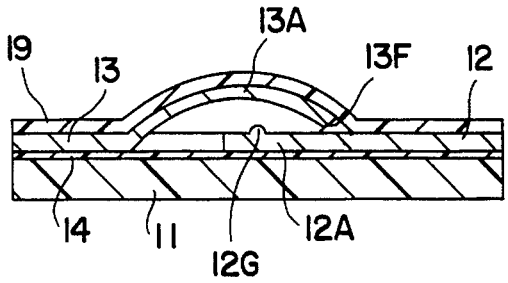
FIG. 11(B) is a cross sectional view of the thin switch shown in FIG. 11(A).
Figure 11A:
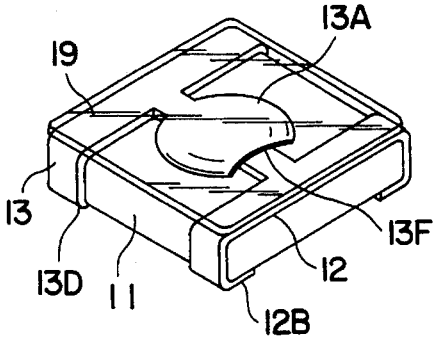
FIG. 11 (A) is a perspective view of a seventh exemplary embodiment of the thin switch according to the present invention.
Figure 12B:
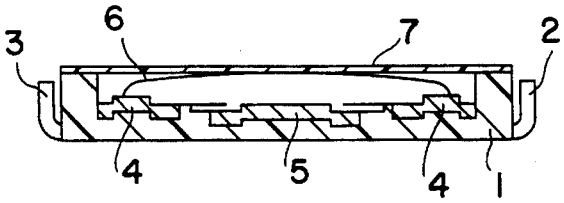
FIG. 12(B) PRIOR ART
FIG. 12(B) is a cross sectional view of the thin switch shown in FIG. 12(A).

FIG. 11(A) and FIG. 11(B) show a seventh exemplary embodiment, where flexible insulating tape 19 with glue on the lower side is pasted on the entire upper side of the thin switch which-is shown in FIG. 9(A) and FIG. 9(B). When an operation member including an operation button is placed over the thin switch, tape 19 provides electrical insulation against the operation member. In addition, this structure can prevent dust from entering the gap between fixed contact 12A and domed contact 13A.

The present invention is not limited to the above exemplary embodiments and various modification are available. For instance, a rectangular thin switch may be used instead of the square thin switch used in the above exemplary embodiments. An oval domed contact, or other shapes, may be used instead of the circular domed contact when necessary. In the above embodiments, one pair of the fixed contact member and movable contact member is mounted on one insulating substrate. However, a plurality of pairs can be mounted on one insulating substrate.

Although illustrated and described herein with reference to certain specific embodiments, the present invention is nevertheless not intended to be limited to the details shown. Rather, various modifications may be made in the details within the scope and range of equivalents of the claims without departing from the spirit of the invention.

What is claimed:

1. A thin switch comprising:

(a) a rectangular insulating substrate;

(b) a fixed contact member comprising a unitary T-shaped conductive thin metal including a fixed contact, a first terminal, and a first conductive part, wherein said fixed contact is placed at a center of a surface of said insulating substrate, and said first terminal is placed on a first edge of said insulating substrate and said fixed contact member is attached to said insulating substrate; and (c) a movable contact member comprising a unitary T-shaped, elastic and conductive thin metal including a domed contact, a second terminal and a second conductive part, wherein said domed contact is placed over said fixed contact, said second terminal is placed on a second edge of said insulating substrate and said movable contact member is attached to said insulating substrate.

2. The thin switch of claim 1 wherein both said fixed contact member and said movable contact member are made from a thin metal strip.

3. The thin switch of claim 1 wherein said fixed contact member and said movable contact member are attached to said insulating substrate with bonding material.

4. The thin switch of claim 1 wherein said fixed contact member and said movable contact member are attached to said insulating substrate by folding portions of said first and second terminals down to contact a rear side of said insulating substrate.

5. The thin switch of claim 1 wherein said fixed contact member and said movable contact member both include protrusions and wherein said fixed contact member and said movable contact member are attached to said insulating substrate by inserting said protrusions into holes provided on said insulating substrate and applying caulk to said protrusions.

6. The thin switch of claim 1 wherein said fixed contact member includes a concave section located proximate to a circumference of said domed contact, wherein said concave section provides an insulating space between said fixed contact member and the circumference of said domed contact.

7. The thin switch of claim 1 wherein a supporting protrusion is provided under said domed contact in order to provide an insulating space between said fixed contact member and a circumference of said domed contact.

8. The thin switch of claim 1 wherein a portion of said domed contact is removed in order to provide an insulating space between said domed contact and said fixed contact member.

9. A thin switch of claim 1 wherein an insulating film is provided between said fixed contact member and said domed contact in order to provide an insulating space between said domed contact and said fixed contact member.

10. The thin switch of claim 1 further comprising a flexible insulating film attached to an upper side of said thin switch.

11. A method of manufacturing a thin switch comprising the steps of:

(a) preparing a rectangular insulating substrate;

(b) forming a unitary T-shaped fixed contact member including a fixed contact, a first conductive part and a first terminal, and a unitary T-shaped movable contact member including a domed contact, a second conductive part and a second terminal, wherein both members are made from a conductive thin strip;

(c) placing said fixed contact member so that said fixed contact is located at a center of a surface of said insulating substrate and said first terminal is located on a first edge of said insulating substrate, and attaching said fixed contact member to said insulating substrate; and (d) placing said movable contact member so that said domed contact is located over said fixed contact and said second terminal is located on a second edge of said insulating substrate, and attaching said movable contact member to said insulating substrate.

12. The manufacturing method of claim 11 wherein the step of forming the fixed contact member and movable contact member is performed by punching and bending processes.

* * * * *